US012753928B2

(12) United States Patent
Johnson et al.

(10) Patent No.: US 12,753,928 B2
(45) Date of Patent: Oct. 6, 2026

(54) COOKING APPLIANCE FOR MULTI-ZONE COOKING AT DIFFERENT TEMPERATURES

(71) Applicant: Haier US Appliance Solutions, Inc., Wilmington, DE (US)

(72) Inventors: Eric Scott Johnson, Louisville, KY (US); James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 790 days.

(21) Appl. No.: 18/181,252

(22) Filed: Mar. 9, 2023

(65) Prior Publication Data

US 2024/0302051 A1 Sep. 12, 2024

(51) Int. Cl.
*F24C 7/08* (2006.01)
*F24C 15/32* (2006.01)

(52) U.S. Cl.
CPC ..... *F24C 7/087* (2013.01); *F24C 7/085* (2013.01); *F24C 15/322* (2013.01)

(58) Field of Classification Search
None
See application file for complete search history.

(56) References Cited

U.S. PATENT DOCUMENTS 4,302,661 A 11/1981 Perry, Jr.
6,114,663 A * 9/2000 Stockley ..... F24C 7/087 219/398
6,355,914 B1 3/2002 Stockley
6,777,652 B2 8/2004 Stockley
(Continued)

FOREIGN PATENT DOCUMENTS

DE 102020203762 A1 * 10/2020 ..... A47J 27/62
JP H06235527 A 8/1994
JP 6006190 B2 10/2016
KR 20050079522 A 8/2005
(Continued)

OTHER PUBLICATIONS

DE 102020203762 A1 (Abellanas Sanchez, Andreas et al.) Oct. 1, 2020 [retrieved on Feb. 21, 2026]. Retrieved from Foreign Image and Text database, translation by Clarivate Analytics. (Year: 2020).*

*Primary Examiner* — John J Norton
(74) *Attorney, Agent, or Firm* — Dority & Manning, P.A.

(57) ABSTRACT

A cooking appliance includes a cabinet forming a cooking chamber, the cooking chamber defining a plurality of cooking zones therein; a plurality of heating elements provided within the cooking chamber; a user interface; and a controller operably connected with the plurality of heating elements and the user interface, the controller configured to perform a cooking operation. The cooking operation includes receiving a first temperature request for a first cooking zone; receiving a second temperature request for a second cooking zone, the second cooking zone being different from the first cooking zone and the second temperature request being different from the first temperature request; determining a heating pattern of the plurality of heating elements based on the first temperature request, the second temperature request, the first cooking zone, and the second cooking zone; and directing each of the plurality of heating elements according to the determined heating pattern.

16 Claims, 4 Drawing Sheets

(56) References Cited

U.S. PATENT DOCUMENTS

| | | | | |
|---|---|---|---|---|
| 7,087,867 | B2 | 8/2006 | Stockley | |
| 7,372,000 | B2 | 5/2008 | Stockley | |
| 7,446,282 | B2 | 11/2008 | Shei et al. | |
| 7,766,003 | B2 | 8/2010 | Kim et al. | |
| 8,138,453 | B2 | 3/2012 | Yang et al. | |
| 8,525,080 | B2 | 9/2013 | Ruther | |
| 8,669,500 | B2 | 3/2014 | Hensel et al. | |
| 8,748,783 | B2 | 6/2014 | Hensel et al. | |
| 8,878,106 | B2 | 11/2014 | Hensel et al. | |
| 10,064,244 | B2 | 8/2018 | Cheng et al. | |
| 10,085,592 | B1 | 10/2018 | Cheng | |
| 10,223,933 | B1 | 3/2019 | Cheng et al. | |
| 10,502,430 | B1 | 12/2019 | Alvey et al. | |
| 11,116,348 | B2 | 9/2021 | Kwon et al. | |
| 11,175,048 | B2 | 11/2021 | Murad | |
| 11,672,050 | B2 | 6/2023 | Cheng et al. | |
| 2006/0289436 | A1 | 12/2006 | Carbone et al. | |
| 2007/0039945 | A1 | 2/2007 | Stockley | |
| 2010/0006561 | A1 | 1/2010 | Hensel et al. | |
| 2017/0017248 | A1 | 1/2017 | Armstrong et al. | |
| 2018/0295676 | A1 | 10/2018 | Cheng et al. | |
| 2019/0008320 | A1 | 1/2019 | Cheng | |
| 2019/0053332 | A1* | 2/2019 | Cheng | F24C 7/046 |
| 2019/0086143 | A1 | 3/2019 | Liss et al. | |
| 2019/0139446 | A1 | 5/2019 | Cheng et al. | |
| 2020/0329909 | A1 | 10/2020 | Conrad et al. | |
| 2021/0080114 | A1* | 3/2021 | Liu | A47J 36/32 |
| 2021/0227647 | A1 | 7/2021 | Jeong et al. | |
| 2021/0231311 | A1 | 7/2021 | Ye et al. | |
| 2021/0353097 | A1 | 11/2021 | Jeong et al. | |
| 2021/0372630 | A1 | 12/2021 | Murad | |
| 2021/0401215 | A1 | 12/2021 | Kwon et al. | |
| 2022/0046931 | A1 | 2/2022 | Iantorno et al. | |
| 2022/0065457 | A1 | 3/2022 | Bailey | |
| 2022/0065459 | A1 | 3/2022 | Murad | |
| 2022/0163212 | A1 | 5/2022 | Mitrik et al. | |
| 2022/0163261 | A1 | 5/2022 | Cadima | |
| 2022/0186937 | A1 | 6/2022 | Murad | |
| 2023/0345585 | A1* | 10/2023 | Bentley | A47L 15/485 |
| 2024/0027073 | A1* | 1/2024 | Nelson | G06T 7/90 |

FOREIGN PATENT DOCUMENTS

| | | | |
|---|---|---|---|
| KR | 100821745 | B1 | 4/2008 |
| KR | 20080095551 | A | 10/2008 |
| WO | WO2014041460 | A1 | 3/2014 |
| WO | WO2014044627 | A2 | 3/2014 |
| WO | WO2019068193 | A1 | 4/2019 |
| WO | WO2021098474 | A1 | 5/2021 |
| WO | WO2021195774 | A1 | 10/2021 |

* cited by examiner

COOKING APPLIANCE FOR MULTI-ZONE COOKING AT DIFFERENT TEMPERATURES

FIELD OF THE INVENTION

The present subject matter relates generally to cooking appliances, and more particularly to multi-zone oven appliances and methods for operating the same.

BACKGROUND OF THE INVENTION

Oven appliances generally include a cabinet that defines a cooking chamber for cooking food items therein, such as by baking or broiling the food items. In order to perform the cooking operation, oven appliances typically include one or more heat sources, or heating elements, provided in various locations within the cooking chamber. These heat sources may be used together or individually to perform various specific cooking operations, such as baking, broiling, roasting, and the like.

Some oven appliances may be able to perform cooking operations on multiple food items simultaneously by allocating zones within the cooking chamber. However, current oven appliances are not able to determine, or may only approximate different cooking times or power levels of different food items placed in the cooking chamber. Accordingly, the cooking operations on multiple food items may lead to undercooked or overcooked foods, depending on what is being cooked, the state at which it is placed in the cooking chamber, and the accuracy of the cooking algorithms.

Accordingly, a method of operating a cooking appliance that obviates one or more of these drawbacks would be beneficial. Particularly, a method of operating an oven appliance that is able to account for multiple temperature zones or cooking parameters would be desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking appliance is provided. The cooking appliance may include a cabinet forming a cooking chamber, the cooking chamber defining a plurality of cooking zones therein; a plurality of heating elements provided within the cooking chamber, each of the plurality of heating elements being independently operated; a user interface configured to receive inputs; and a controller operably connected with the plurality of heating elements and the user interface, the controller configured to perform a cooking operation. The cooking operation may include receiving a first temperature request for a first cooking zone of the plurality of cooking zones via the user interface; receiving a second temperature request for a second cooking zone of the plurality of cooking zones via the user interface, the second cooking zone being different from the first cooking zone and the second temperature request being different from the first temperature request; determining a heating pattern of the plurality of heating elements based on the first temperature request, the second temperature request, the first cooking zone, and the second cooking zone; and directing each of the plurality of heating elements according to the determined heating pattern.

In another exemplary aspect of the present disclosure, a method of operating a cooking appliance is provided. The cooking appliance may include a cooking chamber defining a plurality of cooking zones, a plurality of heating elements provided within the cooking chamber, and a user interface configured to receive inputs. The method may include receiving a request to perform a cooking operation; receiving a first temperature request for a first cooking zone of the plurality of cooking zones via the user interface; receiving a second temperature request for a second cooking zone of the plurality of cooking zones via the user interface, the second cooking zone being different from the first cooking zone and the second temperature request being different from the first temperature request; determining a heating pattern of the plurality of heating elements based on the first temperature request, the second temperature request, the first cooking zone, and the second cooking zone; and directing each of the plurality of heating elements according to the determined heating pattern.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
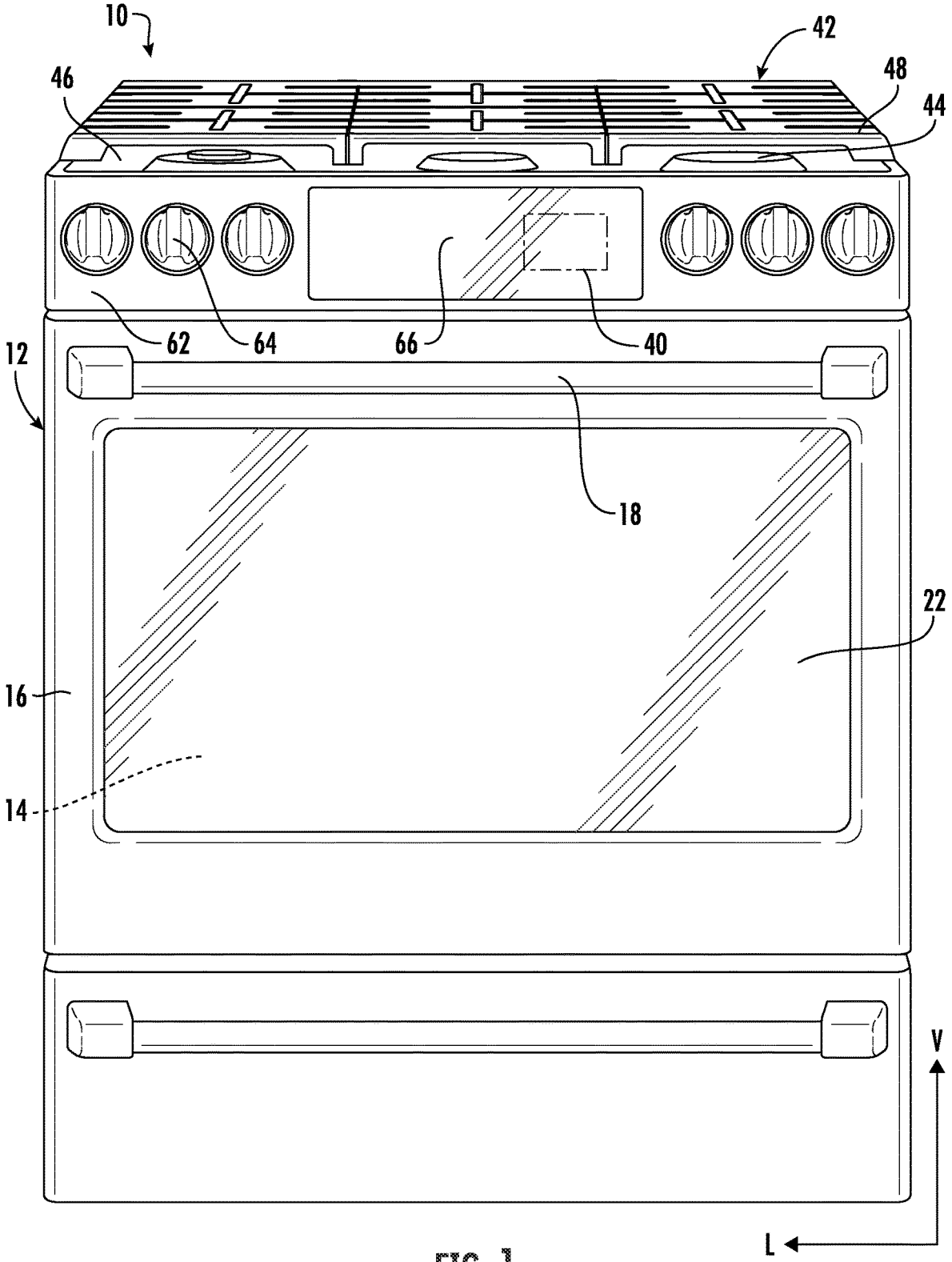
FIG. 1 provides a front view of an exemplary cooking appliance with the door in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Turning now to the figures, FIG. 1 provides a perspective view of a cooking appliance 10 according to exemplary embodiments of the present disclosure. Generally, cooking appliance 10 defines a vertical direction V, a lateral direction L, and a transverse direction T. The vertical direction V, lateral direction L, and transverse direction T are mutually perpendicular and form an orthogonal direction system. As will be understood, cooking appliance 10 is provided by way of example only, and the present subject matter may be used in any suitable appliance. Thus, the present disclosure may be used with other oven, range, or countertop appliance configurations (e.g., configurations that define multiple interior cavities for the receipt of food or are otherwise different than the configuration shown in FIG. 1), as well as other suitable appliances, as would be understood in light of the present disclosure.

Cooking appliance 10 may include an insulated cabinet 12 with an interior cooking chamber 14 defined by an interior surface of cabinet 12. Cooking chamber 14 is configured for the receipt of one or more food items to be cooked. Cooking appliance 10 includes a door 16 rotatably mounted to cabinet 12 (e.g., with a hinge—not shown). A handle 18 may be mounted to door 16 and may assist a user with opening and closing door 16 in order to access an opening to cooking chamber 14. For example, a user can pull on handle 18 to open or close door 16 and access cooking chamber 14 through the opening. As will be described below, one or more internal heating elements (e.g., baking, broiling, or convection heating elements) may be provided within cooking chamber 14 to cook or otherwise heat items therein.

Cooking appliance 10 may include a seal (not shown) between door 16 and cabinet 12 that assist with maintaining heat and cooking fumes within cooking chamber 14 when door 16 is closed, as shown in FIG. 1. One or more parallel glass panes 22 provide for viewing the contents of cooking chamber 14 when door 16 is closed and assist with insulating cooking chamber 14. Optionally, one or more baking racks (FIG. 3) may be positioned in cooking chamber 14 for the receipt of food items or utensils containing food items.

Cooking appliance 10 may include a cooktop surface 42 having one or more heating elements 44 for use in heating or cooking operations. In exemplary embodiments, cooktop surface 42 is comprised of a metal (e.g., steel) panel 46 on which one or more grates 48 may be supported. In other embodiments, however, cooktop surface 42 may be comprised of another suitable material, such as a ceramic glass or another suitable non-metallic material. Heating elements 44 may be various sizes, as shown in FIG. 1, and may employ any suitable method for heating or cooking an object, such as a cooking utensil (not shown), and its contents. In one embodiment, for example, heating element uses a heat transfer method, such as electric coils or gas burners, to heat the cooking utensil. In another embodiment, however, heating element 44 uses an induction heating method to heat the cooking utensil directly. In turn, heating element may include a burner element, electric heat element, induction element, or another suitable heating element.

Some embodiments of cooking appliance 10 include a controller 40 (e.g., configured to control one or more operations of cooking appliance 10). For example, controller 40 may control at least one operation of cooking appliance 10 that includes an internal heating element or cooktop heating element 44. Controller 40 may be in communication (via for example a suitable wired or wireless connection) with one or more of heating element(s) 44 and other suitable components of cooking appliance 10, as discussed herein. In general, controller 40 may be operable to configure cooking appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout cooking appliance 10. As illustrated, controller 40 may be located within a user interface 62 of cooking appliance 10. In some such embodiments, input/output ("I/O") signals may be routed between controller 40 and various operational components of cooking appliance 10, such as heating element(s) 44, control knobs 64, display component 66, sensors, alarms, or other components as may be provided. For instance, signals may be directed along one or more wiring harnesses that may be routed through cabinet 12. In some embodiments, controller 40 is in communication with user interface assembly 62 and control knobs 64 through which a user may select various operational features and modes and monitor progress of cooking appliance 10. In one embodiment, user interface assembly 62 may represent a general purpose I/O ("GPIO") device or functional block. In one embodiment, user interface assembly 62 may include input components, such as one or more of a variety of electrical, mechanical, or electro-mechanical input devices including rotary dials, push buttons, and touch pads. User interface assembly 62 may include a display component 66, such as a digital or analog display configured to provide operational feedback to a user.

While cooking appliance 10 is shown as a cooktop oven combination, the present invention could also be used with other cooking appliances such as, e.g., a stand-alone oven, an oven with a stove-top, or other configurations of such ovens. Numerous variations in the oven configuration are possible within the scope of the present subject matter. For example, variations in the type and/or layout of the user interface assembly 62, as mentioned above, are possible. As another example, cooking appliance 10 may include multiple doors 16 instead of or in addition to the single door 16 illustrated. Such examples include a dual cavity oven, a French door oven, and others. The examples described herein are provided by way of illustration only and without limitation.

User interface assembly 62 (e.g., display 66) may include one or more touch controls. For instance, display 66 may be a touch display (e.g., capacitive touch, proximity touch, pressure switch, etc.) capable of receiving touch inputs from a user relating to cooking operations. Additionally or alternatively, user interface assembly 62 may include one or more additional touch controls separate from display 66 that are capable of receiving touch inputs to control cooking appliance 10. User selections may then be displayed on display 66 to provide visual confirmation to the user of selections made. For instance, multiple selections may be made before initiating a particular cooking operation, as will be described in more detail below.

Figure 2:
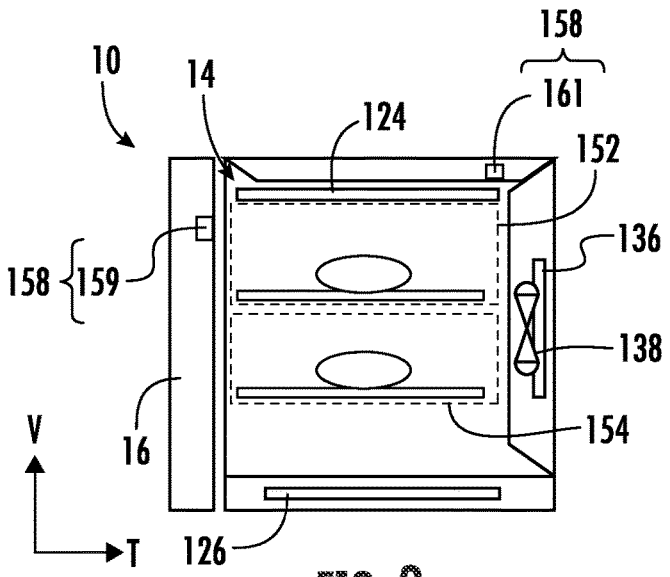
FIG. 2 provides a schematic side view representation of the cooking appliance of FIG. 1 illustrating multiple zones within a cooking chamber.

According to some embodiments, cooking appliance 10 (e.g., within cooking chamber 14) is capable of cooking multiple items at different temperatures within cooking chamber 14. In detail, the cooking operation may receive a plurality of inputs (e.g., user inputs) relating to a plurality of cooking zones (described below) within cooking chamber 14. Accordingly, user interface assembly 62 may prompt a user to select a cooking mode to initiate the specified cooking operation. As shown in FIG. 2, display 66 may display a plurality of potential cooking modes for the user to select.

Referring now to FIGS. 2 through 5, various schematic representations of cooking chamber 14 are provided. As shown in FIG. 2, cooking chamber 14 may be divided into several distinct heating zones. For instance, cooking chamber 14 may include a first heating zone, or zone 1 152, and a second heating zone, or zone 2 154. It should be understood that any suitable number of heating zones may be incorporated into cooking chamber 14, including more than two heating zones. Each of the heating zones may be spaced apart from one another (e.g., along the vertical direction V, the lateral direction L, and/or transverse direction T). In other words, zone 1 152 may be spaced apart from zone 2 154, etc. Accordingly, each heating zone may be controlled separately from one another (e.g., to or at a different temperature or power level, using a different criterion, or using a different heating cycle).

Further, one or more heating elements may be provided at the top, bottom, or both of cooking chamber 14, and may provide heat to cooking chamber 14 for cooking. Such heating element(s) can be gas, electric, microwave, or a combination thereof. For example, in the embodiment shown in FIG. 2, cooking appliance 10 includes a top heating element 124 positioned at a top of cooking chamber 14 and a bottom heating element 126 positioned at a bottom of cooking chamber 14. Other configurations may be used as well. For instance, multiple top heating elements 124 and multiple bottom heating elements 126 may be incorporated.

Cooking appliance 10 may also have a convection heating element 136 and/or convection fan 138 (e.g., collectively a convection heating assembly) positioned adjacent a back wall 116 of cooking chamber 14. Convection fan 138 may be powered by a convection fan motor. Further, convection fan 138 may be a variable speed fan-meaning the speed of fan 138 may be controlled or set anywhere between and including, e.g., zero and one hundred percent (0%-100%). According to at least one example, convection fan 138 is provided as a stand-alone fan (e.g., without an accompanying convection heating element). In certain embodiments, cooking appliance 10 also includes a bidirectional triode thyristor (not shown), i.e., a triode for alternating current (TRIAC), to regulate the operation of convection fan 138 such that the speed of fan 138 may be adjusted during operation of cooking appliance 10. The speed of convection fan 138 may be determined by controller 40. In addition, a sensor such as, e.g., a rotary encoder, a Hall effect sensor, or the like, may be included at the base of fan 138 to sense the speed of fan 138.

The speed of fan 138 may be measured in, e.g., revolutions per minute ("RPM"). In some embodiments, the convection fan 138 may be configured to rotate in two directions, e.g., a first direction of rotation and a second direction of rotation opposing the first direction of rotation. For example, in some embodiments, reversing the direction of rotation, e.g., from the first direction to the second direction or vice versa, may still direct air from the back of cooking chamber 14. As another example, in some embodiments reversing the direction results in air being directed from the top and/or sides of cooking chamber 14 rather than the back of cooking chamber 14. Additionally or alternatively, an effective speed for convection fan 138 may be determined. The effective speed of fan 138 may include adjusting a rotational speed of the fan. Moreover, the effective speed may relate to a duty cycle of fan 138. For instance, an effective speed of fan 138 may incorporate a determined cycle of "ON' and "OFF" times (e.g., in addition to or apart from the rotational speed).

In various embodiments, more than one convection heater assembly, e.g., more than one convection heating element 136 and/or convection fan 138 may be provided. In such embodiments, the number of convection fans and convection heaters may be the same or may differ, e.g., more than one convection heating element 136 may be associated with a single convection fan 138. Similarly, top heating elements and/or bottom heating elements may be provided in various combinations, e.g., one top heating element with two or more bottom heating elements, two or more top heating elements 124, 126 with no bottom heating element, etc.

As shown in FIG. 2, zone 1 152 may be defined within an upper half of cooking chamber 14 (e.g., along the vertical direction V) and zone 2 154 may be defined within a lower half of cooking chamber 14 (e.g., along the vertical direction V, beneath zone 1 152). In detail, zone 1 152 may encompass an entire upper half of cooking chamber 14 while zone 2 154 encompasses an entire lower half of cooking chamber 14. Each of zone 1 152 and zone 2 154 may be at least partially defined by one or more racks, for instance (e.g., provided along the lateral direction L and transverse direction T). Accordingly, a first cooking item (e.g., food item, cookware item, baking item, etc.) may be positioned within zone 1 152 while a second cooking item is positioned within zone 2 154. It should be noted that each of zone 1 152 and zone 2 154 may receive heat or be affected by each active heating element within cooking chamber 14.

Figure 3:
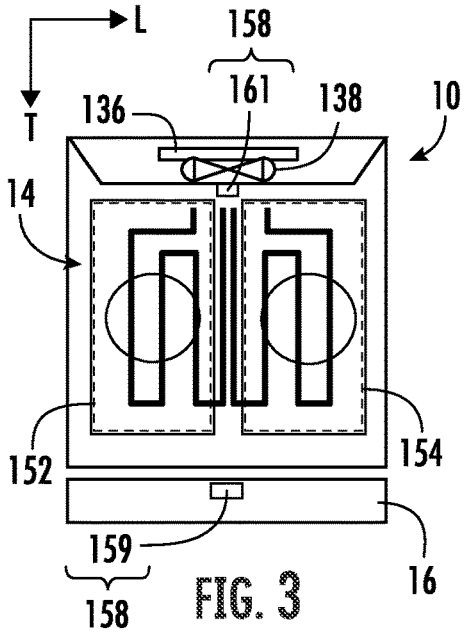
FIG. 3 provides a schematic top view representation of the cooking appliance of FIG. 1 illustrating multiple zones within the cooking chamber.
Figure 4:
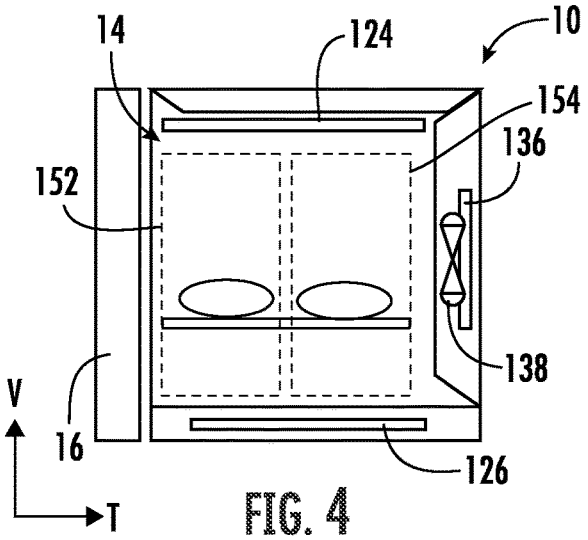
FIG. 4 provides a schematic side view representation of the cooking appliance of FIG. 1 illustrating multiple zones within the cooking chamber.

Similarly, with reference to FIG. 3, zone 1 152 may be defined within a first lateral side of cooking chamber 14 (e.g., a left side) and zone 2 154 may be defined within a second lateral side of cooking chamber 14 (e.g., a right side). According to this example, zone 1 152 encompasses an entire first lateral side of cooking chamber 14 (e.g., from a lateral midpoint of cooking chamber 14 to an inner wall of cooking chamber 14, from a top wall to a bottom wall, and from a back wall to door 16), while zone 2 154 encompasses an entire second lateral side of cooking chamber 14. For yet another example, with reference to FIG. 4, zone 1 152 may be defined within a front portion of cooking chamber 14 while zone 2 154 may be defined within a rear portion of cooking chamber 14. Thus, zone 1 152 may encompass an entire front half of cooking chamber 14 (e.g., from a transverse midpoint of cooking chamber 14 to door 16, from the top wall to the bottom wall, and from the first lateral side to the second lateral side) while zone 2 154 encompasses an entire rear half of cooking chamber 14. Additionally or alternatively, each of the plurality of cooking zones defined within cooking chamber 14 may be arbitrarily defined or selected by a user when initiating a joint cooking operation. For instance, the user may have an option to select an upper zone, a lower zone, a left zone, a right zone, a front zone, a back zone, a central zone, or the like.

Figure 5:
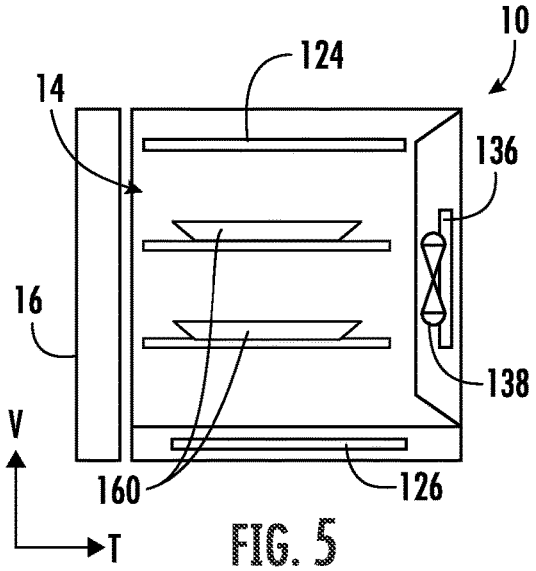
FIG. 5 provides a schematic side view representation of the cooking appliance of FIG. 1 illustrating multiple cookware items within the cooking chamber.

FIG. 5 provides an exemplary schematic view of cooking chamber 14 containing several cookware items. As shown, the cooking items provided within cooking chamber 14 (e.g., within each of first heating zone 152 and second heating zone 154) may have a predetermined size. For instance, each cookware item may occupy a certain percentage of the cooking rack on which they are supported. This in turn may affect an amount of heat (e.g., heat energy) is absorbed by the cookware item and transferred to the contents of the cookware item. Additionally or alternatively, each cookware item may have a unique finish exhibiting a number of specific attributes (e.g., color, reflectivity, texture, shade, etc.). For at least one example, cookware with a lighter color or shade (e.g., silver, white, mirrored, etc.) may reflect more heat or thermal energy (e.g., toward other cooking zones) and absorb less heat or thermal energy. Accordingly, cookware with a darker color or shade (e.g., black, brown, matte, etc.) may absorb more heat or thermal energy. As will be described below, certain operations may be adjusted according to the cookware attributes.

One or more sensors 158 may be provided within cooking chamber 14. The one or more sensors 158 may include, for instance, a camera 159. However, the one or more sensors 158 may include, in addition to or alternatively from the camera, an ultrasonic sensor, an infrared sensor, an optical sensor, or the like. Hereinafter, the one or more sensors 158 will be described with specific reference to a camera (e.g., camera 159). It should be understood that the information or data collected by camera 159 may be obtained through any suitable sensor, such as the aforementioned ultrasonic sensor or optical sensor.

Generally, camera 159 may be a video camera or a digital camera with an electronic image sensor [e.g., a charge coupled device (CCD) or a CMOS sensor]. When assembled, camera 159 is in communication (e.g., electric or wireless communication) with controller 40 such that controller 40 may receive a signal from camera 159 corresponding to the image captured by camera 159. Camera 159 may be configured to capture images of cooking chamber 14 (e.g., each of the plurality of cooking zones). For instance, camera 159 may capture images of food items placed in each of first heating zone 152, second heating zone 154, a third heating zone, or any additional heating zones. Camera 159 may be located in any suitable location within cooking chamber 14, such that each of first heating zone 152 and second heating zone 154 are visible to camera 159. For example, camera 159 may be located at or near a top of cooking chamber 14 along the vertical direction V. Additionally or alternatively, camera 159 may be located at or near a center of cooking chamber 14 along the lateral direction L. The specific location of camera 159 is not limited, however, and one of ordinary skill in the art would appreciate multiple potential locations for camera 159.

The image or images captured by camera 159 may be analyzed (e.g., within controller 40) to determine one or more attributes of a cookware item 160 within cooking chamber 14. For instance, camera 159 may capture an image of cookware item 160 (e.g., roasting pan, baking dish, cookie sheet, etc.) within first heating zone 152. The image may be analyzed to determine certain features of cookware item 160. For instance, the analysis may determine a material, an emissivity, a surface texture, a color, or the like of the cookware item. Such features may selectively alter a heating rate of the items (e.g., food items) within cooking chamber 14. For instance, the attributes of cookware item 160 may affect thermal energy transfer of each of a first food item provided within first heating zone 152 and a second food item provided within second heating zone 154.

The one or more sensors may additionally include a temperature sensor 161. For instance, a single temperature sensor 161 may be provided within cooking chamber 14. Temperature sensor 161 may be positioned, for example, on a back wall, upper wall, or side wall of cooking chamber 14. Temperature sensor 161 may sense (e.g., selectively, continuously) a temperature within cooking chamber 14 (e.g., at predetermined intervals). Additionally or alternatively, temperature sensor 161 may transmit the sensed temperatures to controller 40.

As used herein, "temperature sensor" or the equivalent is intended to refer to any suitable type of temperature measuring system or device positioned at any suitable location for measuring the desired temperature. Thus, for example, the temperature sensor may be any suitable type of temperature sensor, such as a thermistor, a thermocouple, a resistance temperature detector, a semiconductor-based integrated temperature sensor, etc. In addition, the temperature sensor may be positioned at any suitable location and may output a signal, such as a voltage, to a controller that is proportional to and/or indicative of the temperature being measured. Although exemplary positioning of temperature sensors is described herein, it should be appreciated that appliance 10 may include any other suitable number, type, and position of temperature, humidity, and/or other sensors according to alternative embodiments.

Figure 6:
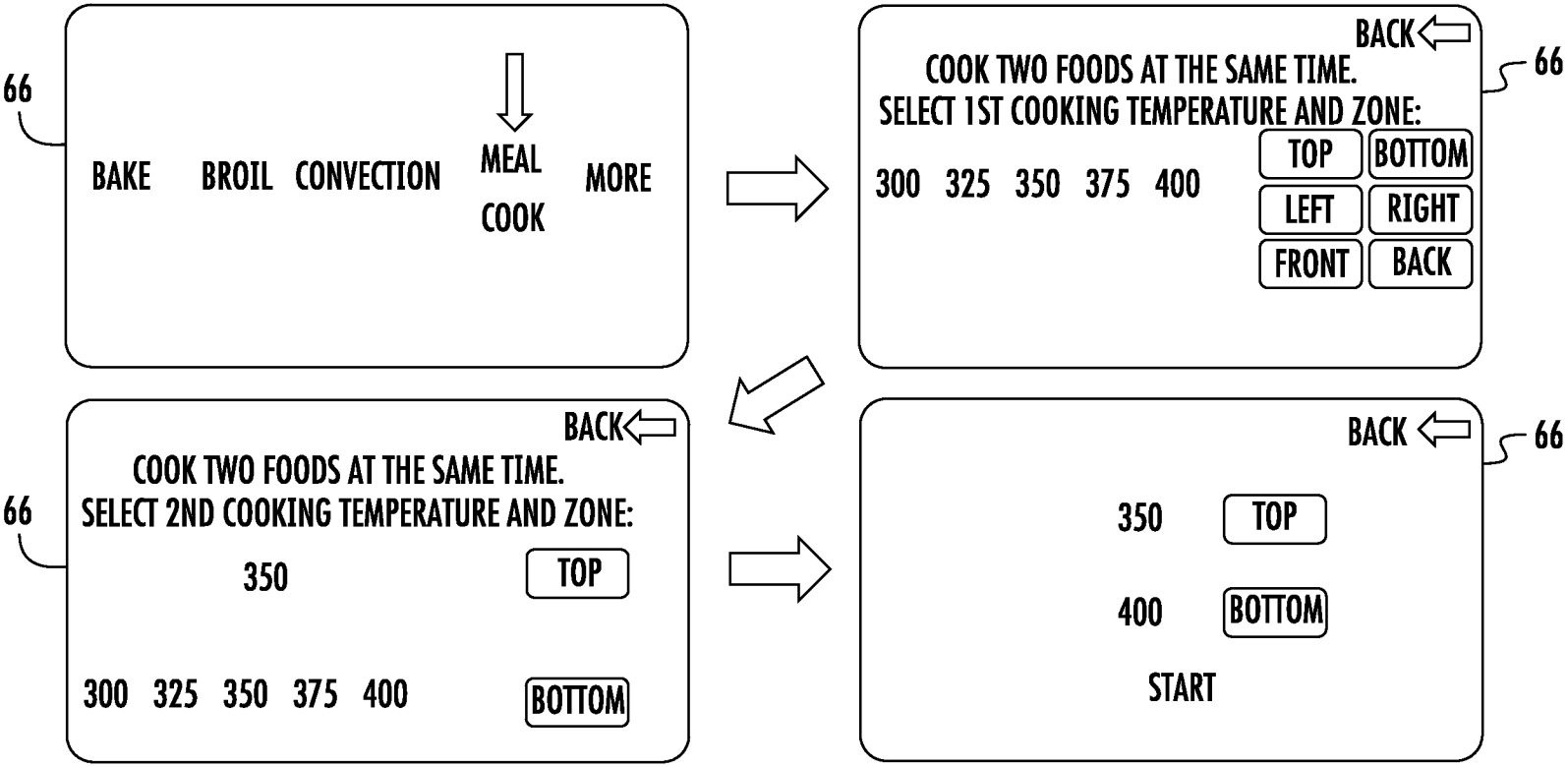
FIG. 6 provides a schematic representation of a display of the exemplary cooking appliance of FIG. 1.

Referring now to FIG. 6, an exemplary selection process for initiating the joint cooking operation will be described. In detail, the user may select (e.g., via user interface assembly 62) the joint cooking operation. In the embodiment shown, the joint cooking operation is referred to as "Meal Cook," however any suitable reference may be used to indicate performing a cooking operation on multiple items requiring different temperatures within cooking chamber 14. User interface assembly 62 (e.g., display 66) may present the user with an option to select a first temperature. The temperature options may be provided to the user in predetermined increments (e.g., 10 degree increments, 25 degree increments, etc.). Optionally, the user may enter a custom temperature for the first temperature.

The first temperature may be associated with a first cooking item. As described, the first cooking item may be a food item, a cookware item, a bake item, or the like. According to one example, the first cooking item is a food item. The first temperature may thus be a temperature at which the first cooking item (e.g., food item) must or should be cooked. The first temperature may be an average temperature that the first cooking item should be exposed to within cooking chamber 14. For instance, the first temperature may be a set temperature within cooking chamber 14 (e.g., within first heating zone 152) at which the first cooking item should be heated.

The user may select a zone (e.g., a heating zone such as first heating zone 152, second heating zone 154, etc.) with which the first temperature will be associated. The user may be presented with a plurality of potential zones. As shown in FIG. 6, the zone options may include a top zone, a bottom zone, a left zone, a right zone, a front zone, or a back zone. Additional or alternative zones may be suggested, however, and the disclosure is not limited to the examples given herein. In some instances, a user may define a custom zone within cooking chamber 14.

The user may then select a second temperature and a second zone (e.g., either concurrently or separately). For instance, upon selecting the first temperature and the first zone, display 66 may present options for the second temperature and the second zone. The options for the second temperature may be limited and may be dependent on the first temperature. For instance, the possible selections for the second temperature may be limited to a range surrounding the first temperature. According to at least one example, if a user selects 350° F. for the first temperature, the options for the second temperature are limited to a range where 350° F. is the midpoint. The range may be a predetermined amount above and below the first temperature. For the example given above, the range may be between 300° F. and 400° F. The range may vary according to specific embodiments, however. Additionally or alternatively, upon selecting the first zone, cooking appliance 10 may automatically select the second zone to be complementary to the first zone. For example, if the top zone is selected as first heating zone 152, the bottom zone is automatically selected as the second heating zone 154.

Figure 7:
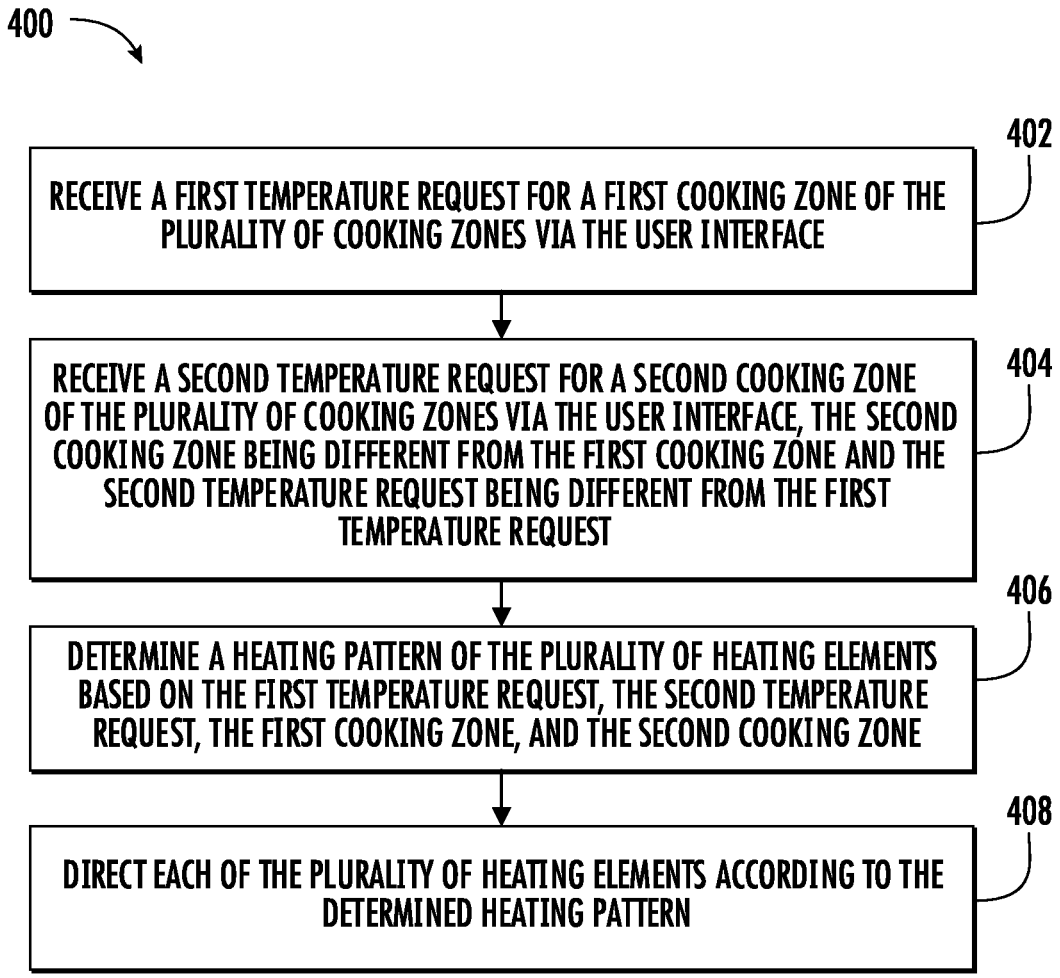
FIG. 7 provides a flow chart illustrating a method of operating a cooking appliance according to exemplary embodiments of the present disclosure.

Now that the general descriptions of an exemplary appliance have been described in detail, a method 400 of operating an appliance (e.g., cooking appliance 10) will be described in detail. Although the discussion below refers to the exemplary method 400 of operating cooking appliance 10, one skilled in the art will appreciate that the exemplary method 400 is applicable to any suitable domestic appliance capable of performing a cooking operation (e.g., such as a cooktop appliance, a stand-alone oven, etc.). In exemplary embodiments, the various method steps as disclosed herein may be performed by controller 40 and/or a separate, dedicated controller. FIG. 7 provides a flow chart illustrating a method of operating a cooking appliance. Hereinafter, method 400 will be described with specific reference to FIG. 7.

At step 402, method 400 may include receiving a first temperature request for a first cooking (e.g., heating) zone of a plurality of cooking zones via the user interface. For instance, as described above, a user may initiate a cooking operation (e.g., a joint cooking operation) by selecting a first temperature at which a first item is to be cooked. The first temperature may be associated with a first cooking zone. The first cooking zone may be selected together with the first temperature, as mentioned above.

At step 404, method 400 may include receiving a second temperature request for a second cooking (e.g., heating) zone of the plurality of cooking zones via the user interface. In detail, the second cooking zone may be different from the first cooking zone. As described above, the first cooking zone may be the top zone within a cooking chamber (e.g., cooking chamber 14), while the second cooking zone is the bottom zone within the cooking chamber. Moreover, the second temperature request may be different from the first temperature request. For instance, the second temperature request may be higher or lower than the first temperature request (e.g., by a predetermined amount). As discussed above, the second temperature request may be bound by an upper limit and a lower limit with regard to the first temperature request.

At step 406, method 400 may include determining a heating pattern of the plurality of heating elements based on the first temperature request, the second temperature request, the first cooking zone, and the second cooking zone. In detail, upon determining the first temperature and zone and the second temperature and zone, the cooking appliance (e.g., via a controller therein) may determine, extrapolate, or otherwise calculate a heating pattern to simulate the requested temperatures within the requested zones. The heating pattern may include operations of each of a plurality of heating elements provided within the cooking chamber (e.g., top heating element 124, bottom heating element 126, convection heating element 136, convection fan 138, etc.). The heating pattern may thus determine specific operational attributes of each of the heaters, including power levels, cycle times, cycle lengths, fan times, cycle repetition, or the like.

For one example, the top zone is the first selected zone at a temperature request of 400° F., and the bottom zone is the second selected zone at a temperature of 350° F. The heating pattern may thus determine that the top zone should receive more heat or thermal energy than the bottom zone. The heating pattern may include operating or directing the top heating element at a higher power level than the bottom heating element. Additionally or alternatively, the top heating element may be cycled more often than the bottom heating element. For instance, each of the top heater (e.g., a broil heater) and the bottom heater (e.g., a bake heater) may selectively operate at one or more predetermined duty cycles. According to the determined heating pattern, the duty cycle of each of the top heater and bottom heater may be adjusted to simulate the requested temperatures. Additionally or alternatively, as mentioned above, a size, shape, color, finish, or other attribute of a cookware item detected within the cooking chamber (e.g., within a particular zone) may influence the determined heating pattern.

The heating pattern may include a cooking operation heating pattern as well as a preheat heating pattern. In detail, the determined heating pattern may adjust the operational attributes (e.g., power level, duty cycle) of each of the heating elements during each of a preheat phase (e.g., warming up the cooking chamber) and a cooking phase (e.g., performing the cooking operation). For instance, the heating pattern may adjust a power level of the top heater during the preheat phase to generate more heat at or near the top zone before any item is placed into the cooking chamber.

A third or other additional heater may be adjusted according to the determined heating pattern. For instance, the convection heating assembly (e.g., convection heater 136 and convection fan 138) may be powered at a determined power level or duty cycle. Accordingly, air within cooking chamber may be cycled in specific manners or patterns to drive warmer air toward the zone with the higher requested temperatures. In some embodiments, exhaust of the convection air is determined according to a specific vent or exit depending on which zone has a higher requested temperature. In one example, the convection air is exhausted from a top of the cooking chamber when the top zone temperature is higher than a bottom zone temperature.

At step 408, method 400 may include directing each of the plurality of heating elements according to the determined heating pattern. For instance, upon determining the heating pattern in response to receiving the first temperature request and zone selection and second temperature request and zone selection, the cooking operation (e.g., joint cooking operation) may be initiated. Each of the heating elements required to perform the cooking operation (e.g., to simulate the requested temperatures within the requested zones) may be directed accordingly throughout the preheat phase and the cooking phase. Advantageously, multiple different temperatures may be simulated within a single cooking chamber to perform different heating operations on multiple items provided within the cooking chamber. Accordingly, total heating times may be reduced by eliminating the need for single heating operations to be performed in series.

According to some additional embodiments, method 400 may include adjusting a determined temperature at which the oven appliance transitions from the preheat phase to the cook phase. For instance, in order to achieve the different effective temperatures within each respective cooking or heating zone, the method may determine a proper time for the cooking operation to switch from the preheat phase to the cook phase, which may include adjusting a power output, duty cycle, or power ratio of each of the heating elements. Additionally or alternatively, the method may include adjusting a target temperature (e.g., within the cooking chamber as sensed by the temperature sensor) to which the oven appliance (e.g., the plurality of heating elements) is tasked to maintain. Accordingly, adjusting a target temperature of the cooking chamber (e.g., a target temperature within at least one of the plurality of cooking or heating zones) may be incorporated to effectively simulate the two different requested temperatures.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance comprising:

a cabinet forming a cooking chamber, the cooking chamber defining a plurality of cooking zones therein;

a plurality of heating elements provided within the cooking chamber, each of the plurality of heating elements being independently operated, wherein the plurality of heating elements comprises a broil heating element provided at a top of the cooking chamber, a bake heating element provided at a bottom of the cooking chamber, and a convection heating assembly provided at a rear of the cooking chamber, wherein the convection heating assembly comprises a convection fan;

a user interface configured to receive inputs; and a controller operably connected with the plurality of heating elements and the user interface, the controller configured to perform a cooking operation, the cooking operation comprising:

receiving a first temperature request for a first cooking zone of the plurality of cooking zones via the user interface;

receiving a second temperature request for a second cooking zone of the plurality of cooking zones via the user interface, the second cooking zone being different from the first cooking zone and the second temperature request being different from the first temperature request;

determining a heating pattern of the plurality of heating elements based on the first temperature request, the second temperature request, the first cooking zone, and the second cooking zone, wherein determining the heating pattern comprises determining an effective speed and rotational direction for the convection fan according to the first temperature request, the second temperature request, the first cooking zone, and the second cooking zone; and directing each of the plurality of heating elements according to the determined heating pattern, wherein directing each of the plurality of heating elements comprises directing the convection fan according to the determined effective speed and rotational direction.

2. The cooking appliance of claim 1, wherein the cooking operation comprises:

a cook phase during which each of the plurality of heating elements is cycled according to the determined heating pattern.

3. The cooking appliance of claim 2, wherein determining the heating pattern comprises:

determining a required power level of each of the plurality of heating elements during the cook phase;

determining a power ratio between the plurality of heating elements during the cook phase; and directing each of the plurality of heating elements at the required power level and according to the determined power ratio during the cook phase to create a temperature ratio between the plurality of cooking zones within the cooking chamber.

4. The cooking appliance of claim 2, wherein the cooking operation further comprises:

a preheat phase during which each of the plurality of heating elements is driven to a predetermined power level, the preheat phase being performed prior to the cook phase.

5. The cooking appliance of claim 4, wherein determining the heating pattern comprises:

determining a required power level of each of the plurality of heating elements during the preheat phase;

determining a power ratio between the plurality of heating elements during the preheat phase; and directing each of the plurality of heating elements at the required power level and according to the determined power ratio during the preheat phase to create a temperature ratio between the plurality of cooking zones within the cooking chamber.

6. The cooking appliance of claim 1, wherein determining the heating pattern comprises:

determining a location of the first cooking zone with respect to the broil heating element and the bake heating element;

determining a location of the second cooking zone with respect to the broil heating element and the bake heating element; and directing each of the broil heating element and the bake heating element according to the location of the first cooking zone, the location of the second cooking zone, the first temperature request of the first cooking zone, and the second temperature request of the second cooking zone.

7. The cooking appliance of claim 6, wherein the broil heating element is directed according to a first duty cycle and the bake heating element is directed according to a second duty cycle.

8. The cooking appliance of claim 1, wherein the cooking operation further comprises:

determining one or more attributes of a cookware item within the cooking chamber.

9. The cooking appliance of claim 8, further comprising:

a sensor configured to sense one or more attributes of the cookware item within the cooking chamber, wherein the sensor is an optical sensor.

10. The cooking appliance of claim 8, wherein determining the heating pattern comprises:

directing each of the plurality of heating elements based at least in part on the one or more determined attributes of the cookware item.

11. A method of operating a cooking appliance, the cooking appliance comprising a cooking chamber defining a plurality of cooking zones, a plurality of heating elements provided within the cooking chamber, wherein the plurality of heating elements comprises a broil heating element provided at a top of the cooking chamber, a bake heating element provided at a bottom of the cooking chamber, and a convection heating assembly provided at a rear of the cooking chamber, wherein the convection heating assembly comprises a convection fan, and a user interface configured to receive inputs, the method comprising:

receiving a request to perform a cooking operation;

receiving a first temperature request for a first cooking zone of the plurality of cooking zones via the user interface;

receiving a second temperature request for a second cooking zone of the plurality of cooking zones via the user interface, the second cooking zone being different from the first cooking zone and the second temperature request being different from the first temperature request;

determining a heating pattern of the plurality of heating elements based on the first temperature request, the second temperature request, the first cooking zone, and the second cooking zone, wherein determining the heating pattern comprises determining an effective speed and rotational direction for the convection fan according to the first temperature request, the second temperature request, the first cooking zone, and the second cooking zone; and directing each of the plurality of heating elements according to the determined heating pattern, wherein directing each of the plurality of heating elements comprises directing the convection fan according to the determined effective speed and rotational direction.

12. The method of claim 11, wherein determining the heating pattern comprises:

determining a power ratio between the plurality of heating elements during the cooking operation; and directing each of the plurality of heating elements according to the determined power ratio during the cooking operation to create a temperature ratio between the plurality of cooking zones within the cooking chamber.

13. The method of claim 12, wherein the cooking appliance further comprises a camera provided in the cooking chamber, the method further comprising:

capturing, via the camera, an image of the cooking chamber;

determining one or more attributes of a cookware item within the cooking chamber via the captured image; and directing each of the plurality of heating elements based at least in part on the one or more determined attributes of the cookware item.

14. The method of claim 11, wherein determining the heating pattern comprises:

determining a required power level of at least one of the plurality of heating elements to reach the first temperature request during the cooking operation; and directing the at least one of the plurality of heating elements at the required power level during the cooking operation.

15. The method of claim 11, wherein determining the heating pattern comprises:

determining a location of the first cooking zone with respect to the broil heating element and the bake heating element;

determining a location of the second cooking zone with respect to the broil heating element and the bake heating element; and directing each of the broil heating element and the bake heating element according to the location of the first cooking zone, the location of the second cooking zone, the first temperature request of the first cooking zone, and the second temperature request of the second cooking zone.

16. The method of claim 15, wherein the broil heating element is directed according to a first duty cycle and the bake heating element is directed according to a second duty cycle.

* * * * *